US011255338B2

(12) United States Patent
Brun et al.

(10) Patent No.: US 11,255,338 B2
(45) Date of Patent: Feb. 22, 2022

(54) METHODS AND MECHANISMS FOR SURGE AVOIDANCE IN MULTI-STAGE CENTRIFUGAL COMPRESSORS

(71) Applicant: Elliott Company, Jeannette, PA (US)

(72) Inventors: Klaus Brun, Export, PA (US); Vishal Jariwala, Jeannette, PA (US)

(73) Assignee: Elliott Company, Jeannette, PA (US)

( * ) Notice: Subject to any disclaimer, the term of this patent is extended or adjusted under 35 U.S.C. 154(b) by 0 days.

(21) Appl. No.: 16/997,221

(22) Filed: Aug. 19, 2020

(65) Prior Publication Data

US 2021/0102546 A1 Apr. 8, 2021

Related U.S. Application Data

(60) Provisional application No. 62/911,697, filed on Oct. 7, 2019.

(51) Int. Cl.

| | |
|---|---|
| ***F04D 29/44*** | (2006.01) |
| ***F04D 27/02*** | (2006.01) |
| ***F04D 17/12*** | (2006.01) |
| ***F04D 29/28*** | (2006.01) |
| ***F04D 27/00*** | (2006.01) |

(52) U.S. Cl.

CPC ..... *F04D 27/0215* (2013.01); *F04D 17/12* (2013.01); *F04D 17/122* (2013.01); *F04D 27/009* (2013.01); *F04D 27/0207* (2013.01); *F04D 27/0246* (2013.01); *F04D 29/284* (2013.01); *F04D 29/441* (2013.01); *F05D 2270/101* (2013.01)

(58) Field of Classification Search

CPC ..... F04D 17/12; F04D 17/122; F04D 27/009; F04D 27/0207; F04D 27/0215; F04D 27/0246; F04D 29/284; F04D 29/441; F04D 29/448; F05D 2270/101

See application file for complete search history.

(56) References Cited

U.S. PATENT DOCUMENTS

| | | | | |
|---|---|---|---|---|
| 1,796,053 | A * | 3/1931 | Schmidt | F04D 27/0215 415/1 |
| 2,276,965 | A * | 3/1942 | Halliday | F04D 29/063 415/111 |
| 2,520,697 | A | 8/1950 | Smith | |
| 4,203,701 | A | 5/1980 | Abbey | |
| 4,230,437 | A | 10/1980 | Bellinger et al. | |
| 4,493,608 | A | 1/1985 | Paul | |
| 4,618,310 | A | 10/1986 | Michelson | |
| 4,807,150 | A | 2/1989 | Hobbs | |
| 4,930,978 | A | 6/1990 | Khanna et al. | |

(Continued)

FOREIGN PATENT DOCUMENTS

| | | | |
|---|---|---|---|
| JP | H1227900 | A | 9/1989 |
| JP | H254400 | U | 4/1990 |

*Primary Examiner* — Ninh H. Nguyen

(74) *Attorney, Agent, or Firm* — The Webb Law Firm

(57) ABSTRACT

A turbomachine includes a casing having an inlet end opposite an outlet end along a longitudinal axis of the casing; a shaft assembly provided within the casing, the shaft assembly extending from the inlet end to the outlet end; a plurality of rotating impellers extending radially outward from the shaft assembly; and a communication channel defined between two adjacent impellers to permit a backflow of fluid from a diffuser channel of a downstream impeller to a return channel of an adjacent upstream impeller.

19 Claims, 8 Drawing Sheets

(56) References Cited

U.S. PATENT DOCUMENTS

| | | | | |
|---|---|---|---|---|
| 4,971,516 | A | 11/1990 | Lawless et al. | |
| 5,599,161 | A | 2/1997 | Batson | |
| 7,069,733 | B2 | 7/2006 | Lucas et al. | |
| 7,736,126 | B2 | 6/2010 | Joco et al. | |
| 8,176,725 | B2 | 5/2012 | Norris et al. | |
| 8,272,832 | B2 * | 9/2012 | Yin | F04D 29/4213 415/58.4 |
| 9,074,606 | B1 | 7/2015 | Moore | |
| 9,382,911 | B2 * | 7/2016 | Sun | F25B 1/10 |
| 2013/0272909 | A1 | 10/2013 | Nawrocki | |
| 2016/0040680 | A1 | 2/2016 | Galeotti et al. | |
| 2016/0327050 | A1 * | 11/2016 | Nakaniwa | F04D 17/122 |

* cited by examiner

METHODS AND MECHANISMS FOR SURGE AVOIDANCE IN MULTI-STAGE CENTRIFUGAL COMPRESSORS

CROSS REFERENCE TO RELATED APPLICATIONS

The present application claims priority to U.S. Provisional Patent Application No. 62/911,697, filed on Oct. 7, 2019, which is incorporated herein by reference in its entirety.

BACKGROUND OF THE INVENTION

Field of the Invention

The present disclosure relates, generally, to turbomachines and other mechanisms and, more particularly, to mechanisms for avoiding surge in multi-stage centrifugal compressors.

Description of Related Art

Turbomachines, such as centrifugal flow compressors, axial flow compressors, and turbines may be utilized in various industries. Centrifugal flow compressors and turbines, in particular, have a widespread use in power stations, jet engine applications, oil and gas process industries, gas turbines, and automotive applications. Centrifugal flow compressors and turbines are also commonly used in large-scale industrial applications, such as air separation plants and hot gas expanders used in the oil refinery industry. Centrifugal compressors are further used in large-scale industrial applications, such as refineries and chemical plants.

With reference to FIG. 1, a multi-stage, centrifugal-flow turbomachine 10 is illustrated in accordance with a conventional design. In some applications, a single stage may be utilized. In other applications, multiple stages may be utilized. Such a turbomachine 10 generally includes a shaft 20 supported within a housing 30 by a pair of bearings 40. The turbomachine 10 shown in FIG. 1 includes a plurality of stages to progressively increase the pressure of the working fluid. Each stage is successively arranged along the longitudinal axis of turbomachine 10, and all stages may or may not have similar components operating on the same principle.

With continued reference to FIG. 1, an impeller 50 includes a plurality of rotating blades 60 circumferentially arranged and attached to an impeller hub 70 which is, in turn, attached to the shaft 20. The blades 60 may be optionally attached to a cover 65. A plurality of impellers 50 may be spaced apart in multiple stages along the axial length of the shaft 20. The rotating blades 60 are fixedly coupled to the impeller hub 70 such that the rotating blades 60, along with the impeller hub 70, rotate with the rotation of the shaft 20. The rotating blades 60 rotate downstream of a plurality of stationary vanes or stators 80 attached to a stationary tubular casing. The working fluid, such as a gas mixture, enters and exits the turbomachine 10 in the radial direction of the shaft 20. The rotating blades 60 are rotated with respect to the stators 80 using mechanical power, which is transferred to the fluid. In a centrifugal compressor, the cross-sectional area between the rotating blades 60 within the impeller 50 decreases from an inlet end to a discharge end, such that the working fluid is compressed as it passes through the impeller 50.

Referring to FIG. 2, working fluid, such as a gas mixture, moves from an inlet end 90 to an outlet end 100 of the turbomachine 10. A row of stators 80 provided at the inlet end 90 channels the working fluid into a row of rotating blades 60 of the turbomachine 10. The stators 80 extend within the casing for channeling the working fluid to the rotating blades 60. The stators 80 are spaced apart circumferentially with generally equal spacing between individual struts around the perimeter of the casing. A diffuser 110 is provided at the outlet of the rotating blades 60 for converting excess kinetic energy into a pressure rise from the fluid flow coming off the rotating blades 60. The diffuser 110 optionally has a plurality of diffuser blades 120 extending within a casing. The diffuser blades 120 are spaced apart circumferentially, typically with equal spacing between individual diffuser blades 120 around the perimeter of the diffuser casing. In a multi-stage turbomachine 10, a plurality of return channel vanes 125 are provided at the outlet end 100 of a fluid compression stage for channeling the working fluid to the rotating blades 60 of the next successive stage. In such an embodiment, the return channel vanes 125 provide the function of the stators 80 from the first stage of turbomachine 10. The last impeller in a multi-stage turbomachine typically only has a diffuser, which may be provided with or without the diffuser blades 120. The last diffuser channels the flow of working fluid to a discharge casing (volute) having an exit flange for connecting to the discharge pipe. As shown in FIG. 2, in a single-stage embodiment, the turbomachine 10 includes stators 80 at the inlet end 90 and a diffuser 110 at the outlet end 100.

The performance of a centrifugal compressor is typically defined by its head versus flow map bounded by the surge and stall regions. This map is critical in assessing the operating range of a compressor for both steady-state and transient system scenarios. Specifically, the centrifugal compressor performance map (head or pressure ratio versus flow rate) with the corresponding speed lines indicates that there are two limits on the operating range of the compressor.

Global aerodynamic flow instability, known as surge, sets the limit for low-flow (or high-pressure ratio) operation, while, the condition of maximum allowable flow or choke or "stonewall" sets the high flow limit. The exact location of the surge line on the map can vary depending on the operating condition and, as a result, a typical surge margin is established at 10% to 15% above the stated flow for the theoretical surge line. Surge margin is usually defined as: $SM(\%)=((Q_A-Q_B)/Q_A)\times 100$. $Q_A$ is the actual volume flow at the operating point, and $Q_B$ is the flow at the surge line for the same speed line of the compressor. Most centrifugal compressor manufacturers design the machine to have at least a 15% surge margin during normal operation and set a recycle valve control line at approximately a 10% surge margin. That is, once the surge margin falls below 10%, the recycle valve is opened to keep the compressor operating at the above 10% surge margin line.

Therefore, every compressor has a surge limit on its operating map, where the mechanical power input is insufficient to overcome the hydraulic resistance of the system, resulting in a breakdown and cyclical flow-reversal in the compressor. Surge occurs just below the minimum flow that the compressor can sustain against the existing suction to discharge pressure rise (head). Once surge occurs, the flow reversal reduces the discharge pressure or increases the suction pressure, thus allowing forward flow to resume until the pressure rise again reaches the surge point. This surge cycle continues at a low frequency until some changes take place in the process or the compressor conditions. The frequency and magnitude of the surge flow-reversing cycle depend on the design and operating condition of the machine, but, in most cases, it is sufficient to cause damage to the seals and bearings and sometimes even the shaft and impellers of the machine. Surge is a global instability in a compressor's flow that results in a complete breakdown and flow reversal through the compressor.

The current state of the art for centrifugal compressor surge control is to utilize a global recycle valve to return flow from the discharge side of a centrifugal compressor to the suction side to increase the flow through the compressor and thus avoid entering the surge region. This is conventionally handled by defining a compressor surge control line that conservatively assumes that all stages must be kept out of surge all the time. Specifically, a flow return line provides additional flow through all stages, as opposed to individual stages, of the compressor regardless of whether only one impeller stage of the compressor is in surge or all of them are in surge. This makes recycle operation highly inefficient since the fluid that the compressor has worked on at the expense of energy is simply returned to the compressor's suction for re-working. In compressors with multiple stages, the amount of energy loss is disproportionally large since the energy that was added in each stage is lost during system level (or global) recycling.

SUMMARY OF THE INVENTION

In view of the foregoing problems with the current art of centrifugal compressor surge control, there is a current need in the art for a mechanism or arrangement for centrifugal compressors that provides a more controlled flow recycling to affect only those stages that may be on the verge of surge.

According to a particular example of the present disclosure, a turbomachine is provided. The turbomachine comprises a casing having an inlet end opposite an outlet end along a longitudinal axis of the casing; a shaft assembly provided within the casing, the shaft assembly extending from the inlet end to the outlet end; a plurality of rotating impellers extending radially outward from the shaft assembly; and a communication channel defined between two adjacent impellers to permit a backflow of fluid from a diffuser channel of a downstream impeller to a return channel of an adjacent upstream impeller.

The communication channel may be defined in the casing between the two adjacent impellers.

According to an example, the two adjacent impellers are positioned directly next to each other on the shaft assembly without an additional impeller positioned therebetween.

The communication channel may be a borehole defined in the casing between the two adjacent impellers.

The turbomachine may be a single-stage or multi-stage centrifugal compressor.

According to an example, a control valve is positioned within the communication channel to control a volume of fluid that is directed through the communication channel. The control valve may be a check valve. The control valve may be configured to permit the fluid to flow upstream while preventing the fluid from flowing downstream between the two adjacent impellers. The control valve may be configured to permit the fluid to flow upstream between the two adjacent impellers only after a predetermined pressure is achieved with the fluid.

According to another particular example of the present disclosure, a turbomachine is provided. The turbomachine comprises a casing having an inlet end opposite an outlet end along a longitudinal axis of the casing; a shaft assembly provided within the casing, the shaft assembly extending from the inlet end to the outlet end; a plurality of rotating impellers extending radially outward from the shaft assembly; a communication channel defined between two adjacent impellers to permit a backflow of fluid from a diffuser channel of a downstream impeller to a return channel of an adjacent upstream impeller; and a disk member rotatably positioned on the shaft assembly between the two adjacent impellers.

According to an example, the disk member defines at least one opening that is configured to be rotated between a first position in which the at least one opening is in line with the communication channel and a second position in which the at least one opening is rotated away from the communication channel.

According to an example, the turbomachine further comprises a control mechanism configured to rotate the disk member.

The communication channel may be defined in the casing between the two adjacent impellers.

According to an example, the two adjacent impellers are positioned directly next to each other on the shaft assembly without an additional impeller positioned therebetween.

The communication channel may be a borehole defined in the casing between the two adjacent impellers.

According to an example, the turbomachine is a multi-stage centrifugal compressor.

The disk member may define a plurality of circumferentially spaced openings.

According to another particular example of the present disclosure, a method of reducing a surge in a turbomachine is provided. The method comprises directing fluid through an inlet of the turbomachine; directing the fluid through at least one stage of the turbomachine; recycling a portion of the fluid upstream from a downstream impeller to an adjacent upstream impeller via a communication channel defined in the turbomachine between the two adjacent impellers; and directing the recycled fluid downstream in the turbomachine.

A control valve may be positioned within the communication channel.

A disk member may be provided between the adjacent impellers to control a flow of fluid through the communication channel.

Further preferred and non-limiting embodiments or aspects will now be described in the following numbered clauses.

Clause 1: A turbomachine, comprising: a casing having an inlet end opposite an outlet end along a longitudinal axis of the casing; a shaft assembly provided within the casing, the shaft assembly extending from the inlet end to the outlet end; a plurality of rotating impellers extending radially outward from the shaft assembly; and a communication channel defined between two adjacent impellers to permit a backflow of fluid from a diffuser channel of a downstream impeller to a return channel of an adjacent upstream impeller.

Clause 2: The turbomachine of Clause 1, wherein the communication channel is defined in the casing between the two adjacent impellers.

Clause 3: The turbomachine of Clause 1 or Clause 2, wherein the two adjacent impellers are positioned directly next to each other on the shaft assembly without an additional impeller positioned therebetween.

Clause 4: The turbomachine of any one of Clauses 1-3, wherein the communication channel is a borehole defined in the casing between the two adjacent impellers.

Clause 5: The turbomachine of any one of Clauses 1-4, wherein the turbomachine is a single-stage or multi-stage centrifugal compressor.

Clause 6: The turbomachine of any one of Clauses 1-5, wherein a control valve is positioned within the communication channel to control a volume of fluid that is directed through the communication channel.

Clause 7: The turbomachine of Clause 6, wherein the control valve is a check valve.

Clause 8: The turbomachine of Clause 6 or Clause 7, wherein the control valve is configured to permit the fluid to flow upstream, while preventing the fluid from flowing downstream between the two adjacent impellers.

Clause 9: The turbomachine of any one of Clauses 6-8, wherein the control valve is configured to permit the fluid to flow upstream between the two adjacent impellers only after a predetermined pressure is achieved with the fluid.

Clause 10: A turbomachine, comprising: a casing having an inlet end opposite an outlet end along a longitudinal axis of the casing; a shaft assembly provided within the casing, the shaft assembly extending from the inlet end to the outlet end; a plurality of rotating impellers extending radially outward from the shaft assembly; a communication channel defined between two adjacent impellers to permit a backflow of fluid from a diffuser channel of a downstream impeller to a return channel of an adjacent upstream impeller; and a disk member rotatably positioned on the shaft assembly between the two adjacent impellers.

Clause 11: The turbomachine of Clause 10, wherein the disk member defines at least one opening that is configured to be rotated between a first position in which the at least one opening is in line with the communication channel and a second position in which the at least one opening is rotated away from the communication channel.

Clause 12: The turbomachine of Clause 10 or Clause 11, further comprising a control mechanism configured to rotate the disk member.

Clause 13: The turbomachine of any one of Clauses 10-12, wherein the communication channel is defined in the casing between the two adjacent impellers.

Clause 14: The turbomachine of any one of Clauses 10-13, wherein the two adjacent impellers are positioned directly next to each other on the shaft assembly without an additional impeller positioned therebetween.

Clause 15: The turbomachine of any one of Clauses 10-14, wherein the communication channel is a borehole defined in the casing between the two adjacent impellers.

Clause 16: The turbomachine of any one of Clauses 10-15, wherein the turbomachine is a multi-stage centrifugal compressor.

Clause 17: The turbomachine of any one of Clauses 10-16, wherein the disk member defines a plurality of circumferentially spaced openings.

Clause 18: A method of reducing surge in a turbomachine, comprising: directing fluid through an inlet of the turbomachine; directing the fluid through at least one stage of the turbomachine; recycling a portion of the fluid upstream from a downstream impeller to an adjacent upstream impeller via a communication channel defined in the turbomachine between the two adjacent impellers; and directing the recycled fluid downstream in the turbomachine.

Clause 19: The method of Clause 18, wherein a control valve is positioned within the communication channel.

Clause 20: The method of Clause 18 or Clause 19, wherein a disk member is provided between the adjacent impellers to control a flow of fluid through the communication channel.

Clause 21: A method of reducing surge in a turbomachine, comprising: providing a turbomachine according to any one of Clauses 1-17; directing fluid through the inlet of the turbomachine; directing the fluid through at least one stage of the turbomachine; recycling a portion of the fluid upstream from a downstream impeller to an adjacent upstream impeller via a communication channel defined in the turbomachine between the two adjacent impellers; and directing the recycled fluid downstream in the turbomachine.

Clause 22: The method of Clause 21, wherein a control valve is positioned within the communication channel.

Clause 23: The method of Clauses 21 or Clause 22, wherein a disk member is provided between the adjacent impellers to control a flow of fluid through the communication channel.

Clause 24: The turbomachine according to any one of Clauses 1-9, further comprising: a disk member rotatably positioned on the shaft assembly between the two adjacent impellers.

Clause 25: The turbomachine of Clause 24, wherein the disk member defines at least one opening that is configured to be rotated between a first position in which the at least one opening is in line with the communication channel and a second position in which the at least one opening is rotated away from the communication channel.

Clause 26: The turbomachine of Clause 24 or Clause 25, further comprising a control mechanism configured to rotate the disk member.

Clause 27: The turbomachine of any one of Clauses 24-26, wherein the communication channel is defined in the casing between the two adjacent impellers.

Clause 28: The turbomachine of any one of Clauses 24-27, wherein the two adjacent impellers are positioned directly next to each other on the shaft assembly without an additional impeller positioned therebetween.

Clause 29: The turbomachine of any one of Clauses 24-28, wherein the communication channel is a borehole defined in the casing between the two adjacent impellers.

Clause 30: The turbomachine of any one of Clauses 24-29, wherein the turbomachine is a multi-stage centrifugal compressor.

Clause 31: The turbomachine of any one of Clauses 24-30, wherein the disk member defines a plurality of circumferentially spaced openings.

Clause 32: The turbomachine of any one of Clauses 10-17, further comprising a control valve positioned within the communication channel to control a volume of fluid that is directed through the communication channel.

Clause 33: The turbomachine of Clause 32, wherein the control valve is a check valve.

Clause 34: The turbomachine of Clause 32 or Clause 33, wherein the control valve is configured to permit the fluid to flow upstream while preventing the fluid from flowing downstream between the two adjacent impellers.

Clause 35: The turbomachine of any one of Clauses 32-34, wherein the control valve is configured to permit the fluid to flow upstream between the two adjacent impellers only after a predetermined pressure is achieved with the fluid.

These and other features and characteristics of the present invention, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular forms of "a", "an", and "the" include plural referents unless the context clearly dictates otherwise.

DETAILED DESCRIPTION OF THE INVENTION

Figure 1:
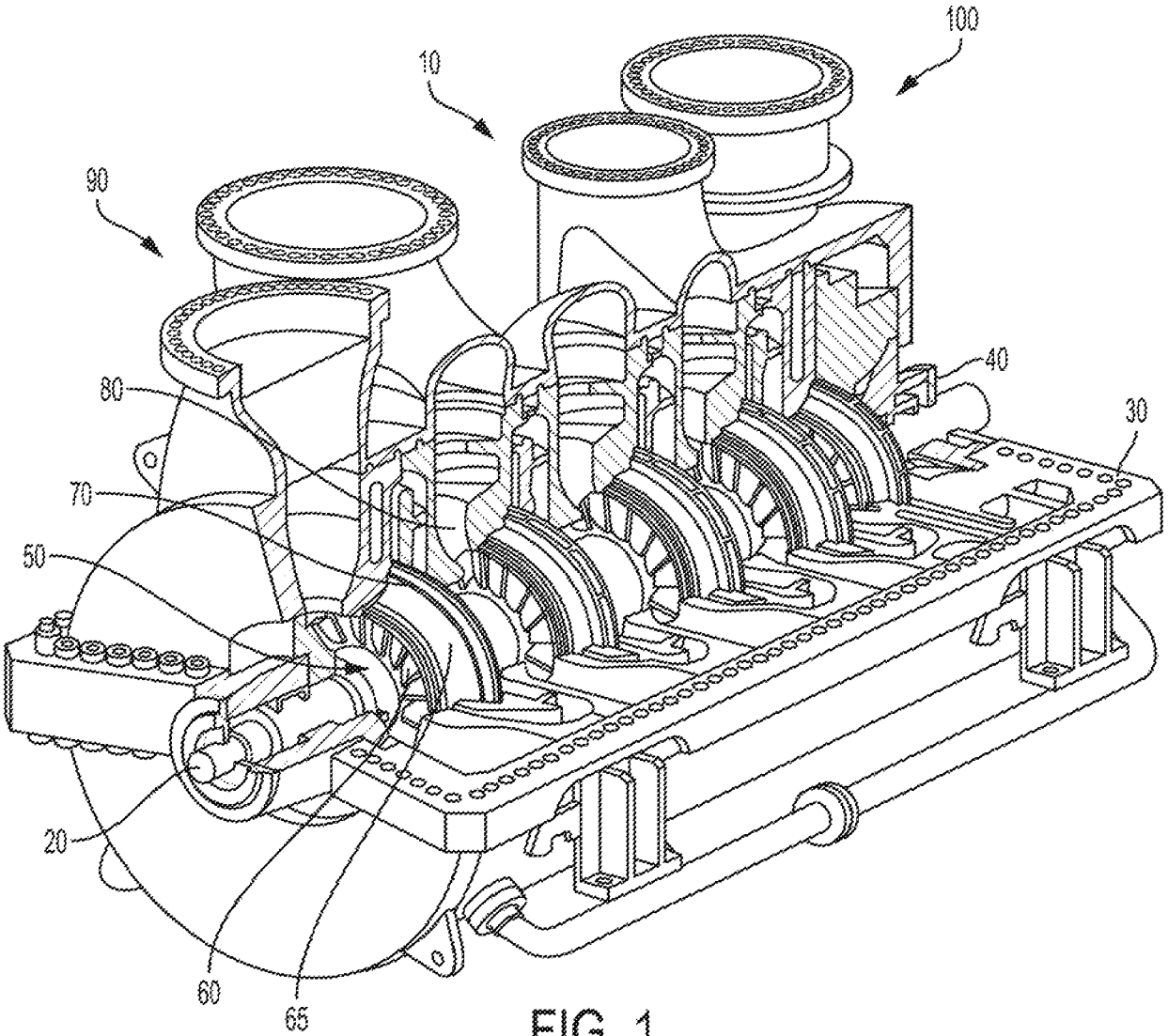
FIG. 1 PRIOR ART
FIG. 1 is a partial-cutaway perspective view of a multi-stage, centrifugal-flow turbomachine in accordance with a prior art example.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings and described in the following specification are simply exemplary embodiments or aspects of the invention. Hence, specific dimensions and other physical characteristics related to the embodiments or aspects disclosed herein are not to be considered as limiting.

Figure 2:
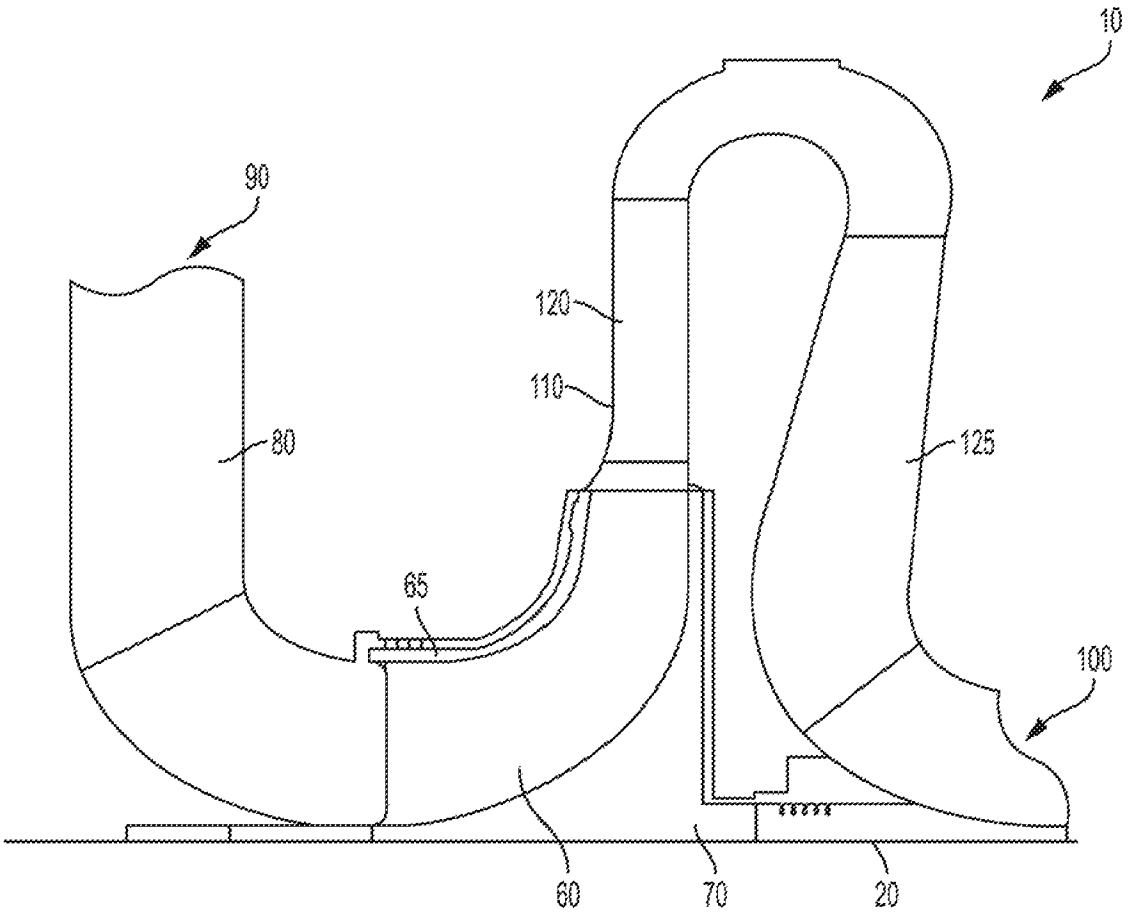
FIG. 2 PRIOR ART
FIG. 2 is a schematic cross-sectional view of one stage of the turbomachine shown in FIG. 1.
Figure 3:
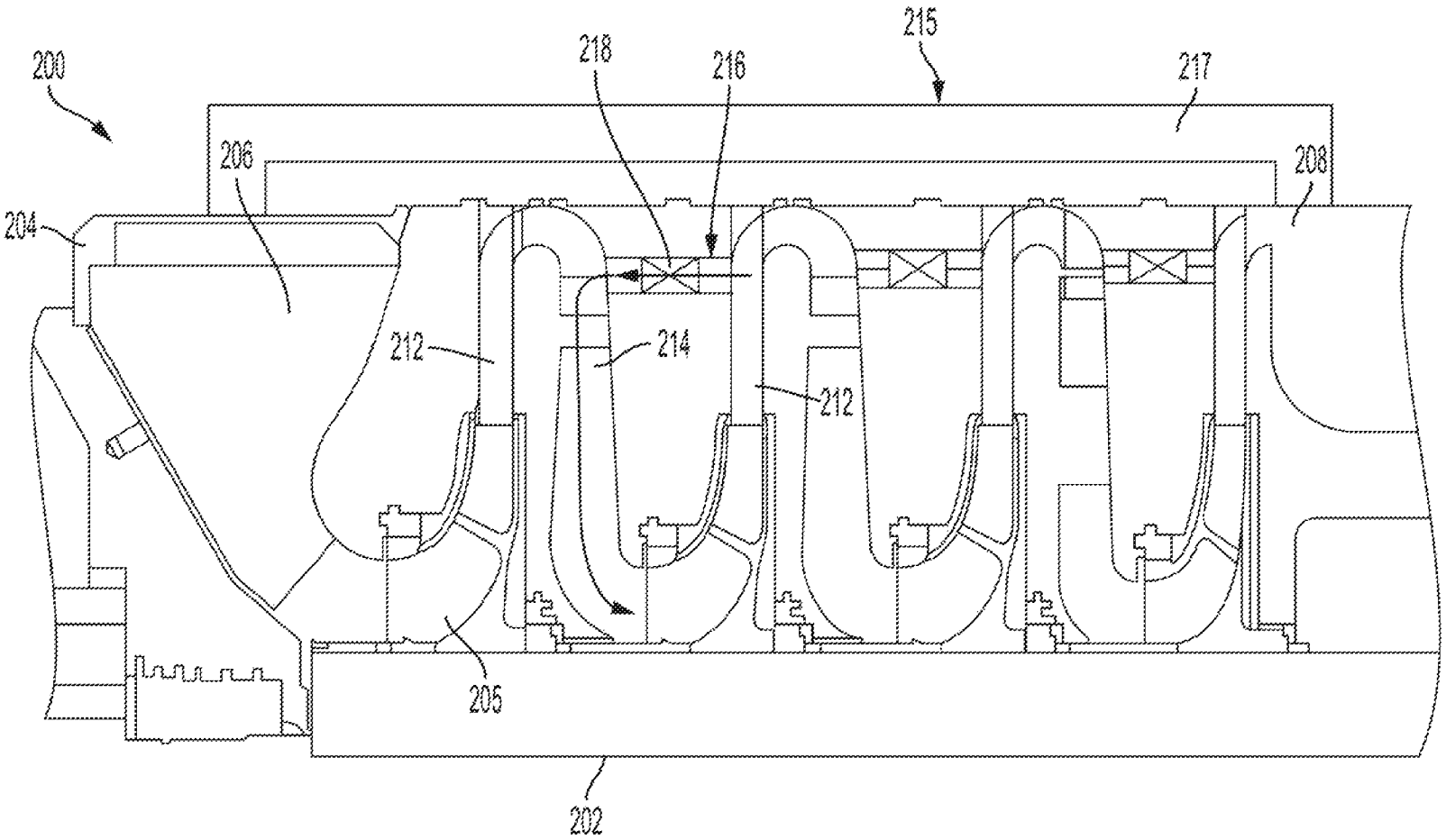
FIG. 3 is a cross-sectional view of a turbomachine according to an example of the present disclosure.

With reference to FIG. 3, a multi-stage centrifugal compressor 200, such as the turbomachine shown in FIGS. 1 and 2, is illustrated. The compressor 200 may include a shaft 202 supported within a casing 204 by a pair of bearings. The compressor 200 may include a plurality of stages to progressively increase the fluid pressure of the working fluid through the compressor 200. Each stage is successively arranged along the longitudinal axis of the compressor 200, and all stages may or may not have similar components operating on the same principle.

With continued reference to FIG. 3, each stage of the compressor 200 may include an impeller 205 that includes a plurality of rotating blades circumferentially arranged and attached to the impeller 205 which is in turn attached to the shaft 202. A plurality of impellers 205 may be spaced apart in multiple stages along the axial length of the shaft 202. The rotating blades may be fixedly coupled to the impeller 205 such that the rotating blades along with the impeller 205 rotate with the rotation of the shaft 202. The working fluid, such as a gas mixture, enters and exits the compressor 200 generally in the radial direction of the shaft 202. The rotation of the blades supplies the energy to the fluid. In a centrifugal compressor, the cross-sectional area between the rotating blades 60 within the impeller 205 decreases from an inlet end to a discharge end, such that the working fluid is compressed as it passes across the impeller 205.

Working fluid, such as a gas mixture, moves from an inlet end (suction end) 206 to an outlet end (discharge end) 208 of the compressor 200. A diffuser channel 212 is provided at the outlet of the rotating blades of the impeller 205 for homogenizing the fluid flow coming off the rotating blades. The diffuser channel 212 optionally has a plurality of diffuser vanes extending within the casing 204. In a multi-stage compressor 200, a plurality of return channels 214 are provided at the outlet end of a fluid compression stage for channeling the working fluid to the rotating blades of the next successive stage. The last impeller 205 in a multi-stage turbomachine typically only has a diffuser channel 212, which may be provided with or without the diffuser vanes. The last diffuser channel 212 directs the flow of working fluid to a discharge casing (generally volute) having an exit flange for connecting to the discharge pipe.

With continued reference to FIG. 3, internal recycling of the working fluid is performed by establishing connections or communication channels 216 between the diffuser channel 212 of a downstream impeller 205 and the return channel 214 of an upstream impeller 205. In a specific example, a communication channel 216 is established between a diffuser channel 212 of a given stage and the upstream return channel 214 at multiple, equally circumferentially spaced locations in the compressor 200. In one example, the communication channel 216 is established between two directly adjacent impellers 205 such that there is no additional impeller positioned between the two adjacent impellers 205. A portion of the working fluid is internally recycled from the diffuser channel 212 of the given stage back to the upstream return channel 214 via the communication channel 216. In one example of the present disclosure, the communication channel 216 may be an aperture or borehole defined in the casing 204 of the compressor 200 that permits the working fluid to pass through to reduce the surge in the compressor 200.

The recycled fluid enters the impeller 205 downstream of the return channel 214 and thus increases the impeller through flow and moves impeller operating conditions away from the surge phenomenon. In another example, the communication channel 216 includes a control valve 218 housed within an aperture defined in the casing 204 of the compressor 200. The control valve 218 may be a check valve or any other valve that is configured to control the flow of working fluid therethrough. In one example, the check valve 218 may only permit the working flow to move from the diffuser channel 212 to the upstream return channel 214 but not from the upstream return channel 214 to the downstream diffuser channel 212. The control valve 218 may only permit the working fluid to pass therethrough after a predetermined pressure has been reached by the working fluid. While only a single communication channel 216 is shown in FIG. 3, it is to be understood that a plurality of communication channels 216 may be provided at the same or similar locations spaced circumferentially from one another about the same point between the diffuser channel 212 and the return channel 214. In one example, each of the plurality of communication channels 216 at the same point are circumferentially equally spaced from one another. The plurality of communication channels creates a generally uniform distribution of flow from the downstream diffuser channel 212 to the upstream return channel 214. The check valves may be operated using an active feedback or a passive feedback mechanism utilizing electrical, magnetic, mechanical, pneumatic, or hydraulic mechanisms.

With continued reference to FIG. 3, in another example of the present disclosure, the compressor 200 may include an arrangement 215 for global recycling in the compressor 200 as well as the stage-by-stage recycling described above. The arrangement 215 may include a return channel 217 that directs working fluid that exits the outlet end 208 to the inlet end 206 of the compressor 200 to further assist in reducing surge in the compressor 200. A global recycling arrangement 215 delivers a metered amount of additional flow from the compressor outlet end 208 to the flow through the inlet end 206 (generally across pressure boundary) in order to move the compressor 200 toward operating conditions away from the surge. It is called global because the said fluid is delivered to the first stage and travels the entire compressor flow path regardless of which stage is in surge.

The internal stage-wise recycling of the working fluid provides a much more controlled flow recycling to affect only those stages of the compressor 200 that may be on the verge of surge. The amount of working fluid flow needed for such an arrangement is much smaller than highly conservative global recycling arrangements. Furthermore, the working fluid flow does not leave the compressor casing 204 and, therefore, does not cross the pressure boundary. In comparison to global recycling arrangements, the currently disclosed internal stage-wise recycling arrangement has less pressure loss depending on the application and specific control design.

Figure 4:
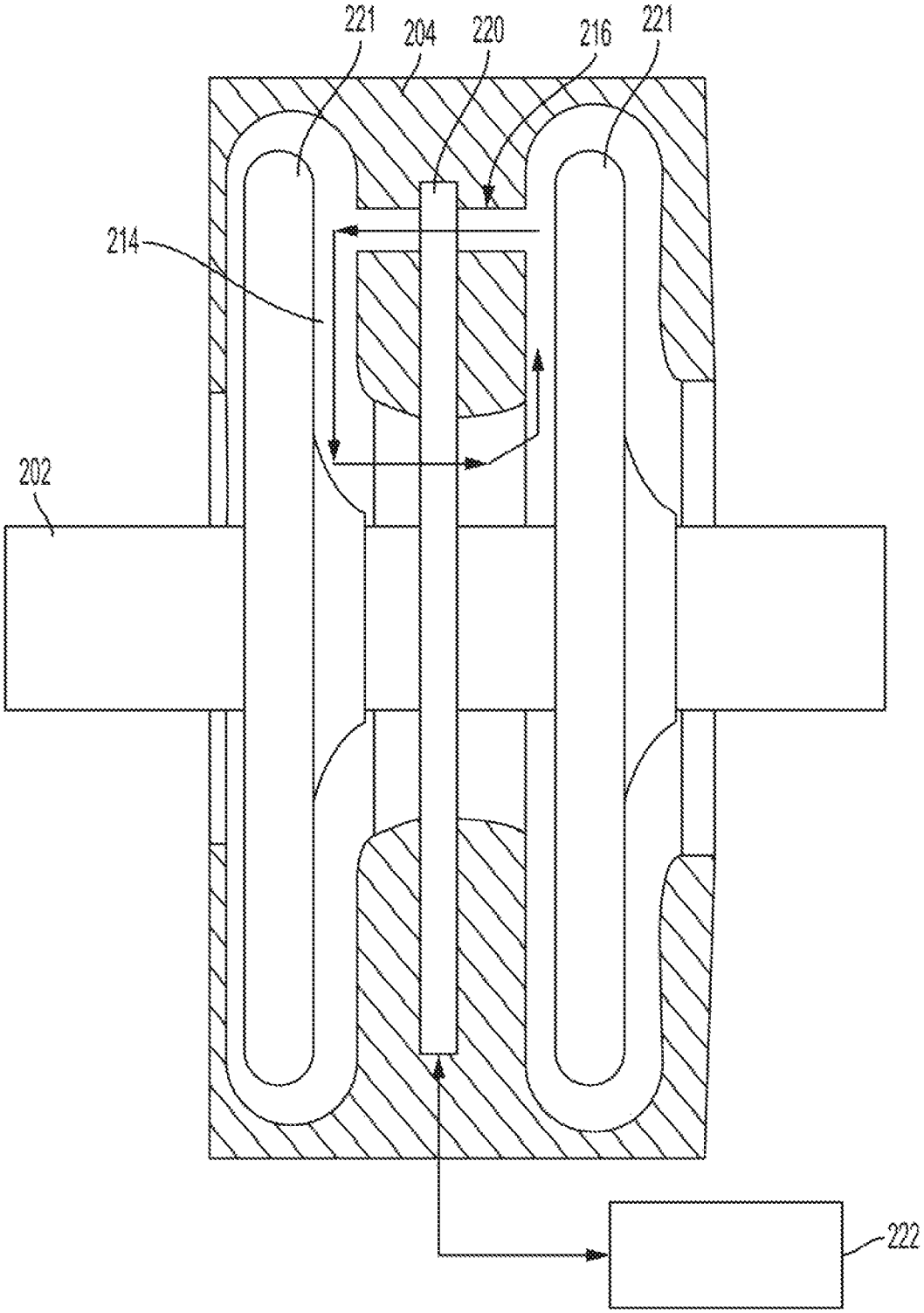
FIG. 4 is a cross-sectional view of a portion of a turbomachine according to another example of the present disclosure.

With reference to FIG. 4, another example of the present disclosure is shown and described. In this example, instead of providing the control valve 218 in the communication channel 216, a slotted disk member 220 intersecting with the communication channel 216 is provided within the casing 204. The disk member 220 may be rotationally held on the shaft 202 that extends longitudinally through the casing 204 of the compressor 200 such that the disk member 220 may be rotated about the shaft 202. In one example, the disk member 220 may be held between diaphragms 221 provided in two adjacent stages of the compressor 200. Actuation of the disk member 220 may be achieved using a control mechanism 222 operated by a user of the compressor 200. It is also contemplated that the control mechanism 222 includes pre-programmed instructions for actuating the disk member 220 based on predetermined conditions of the compressor 200 or predetermined time intervals during operation of the compressor 200. According to an example, the control mechanism 222 may be a hydraulic, pneumatic, electric, magnetic, or mechanical actuator that is placed outside of the compressor casing 204.

Figure 5:
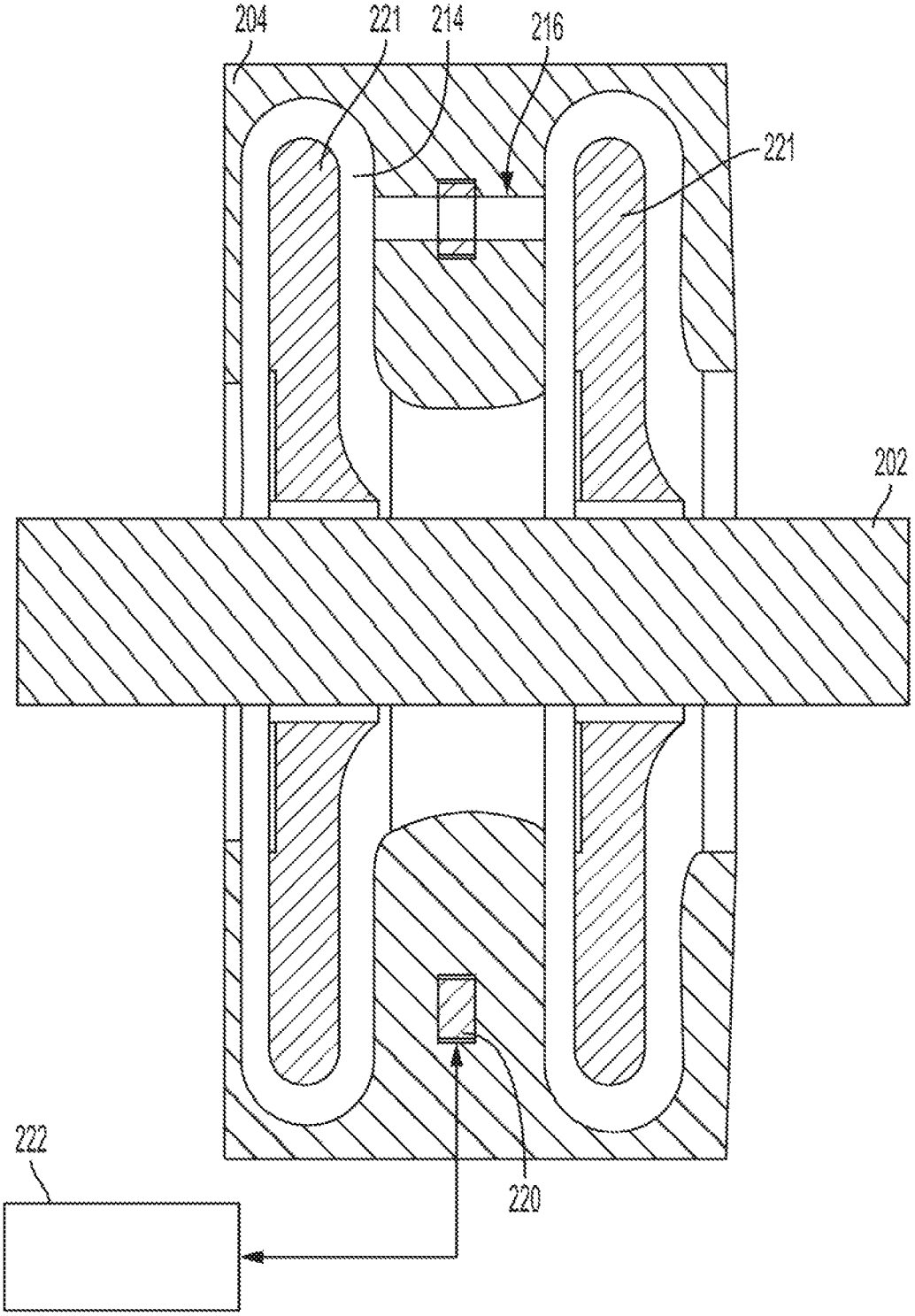
FIG. 5 is another cross-sectional view of the turbomachine of FIG. 4.
Figure 6:
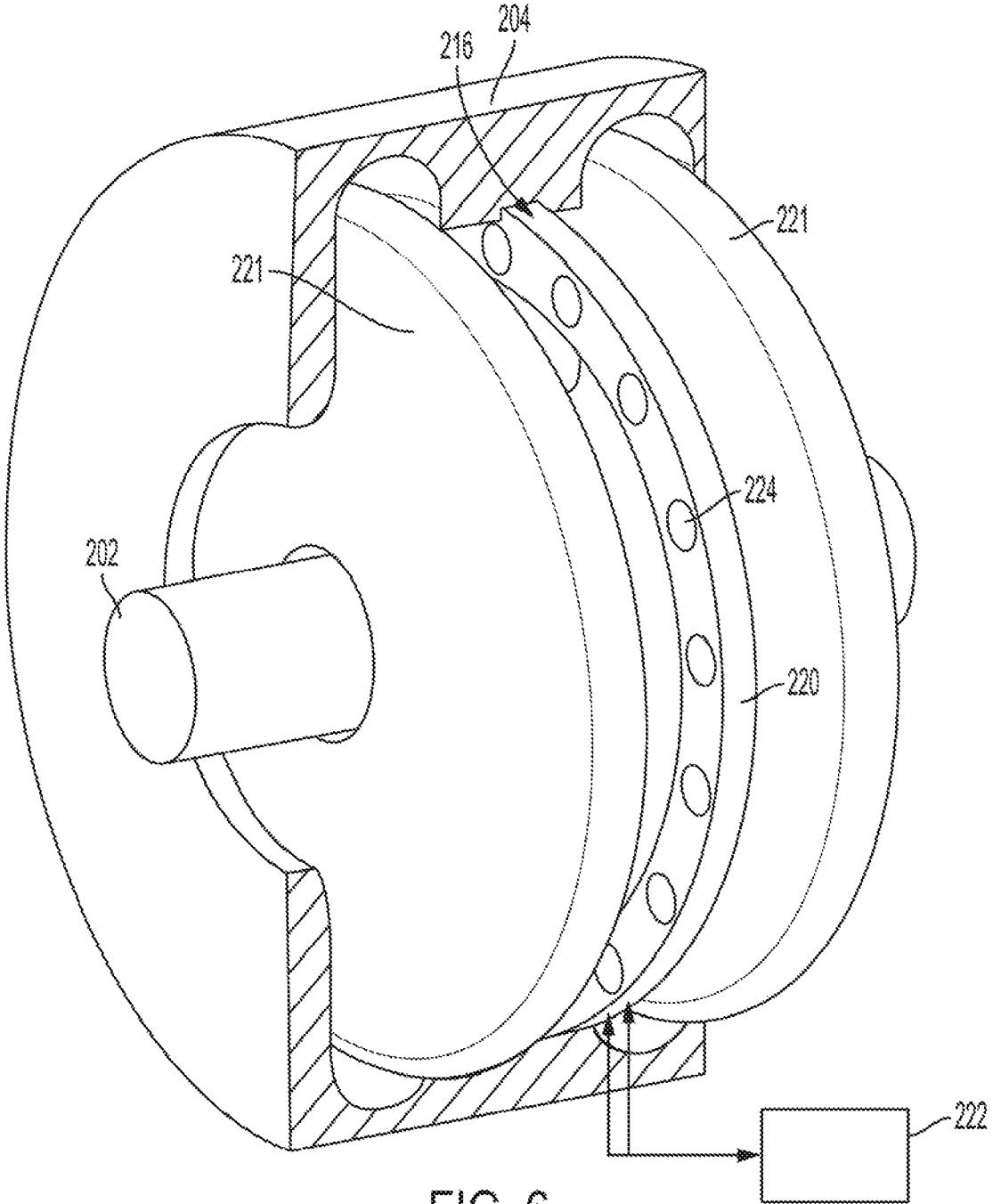
FIG. 6 is a cross-sectional perspective view of the turbomachine of FIG. 4.
Figure 7:
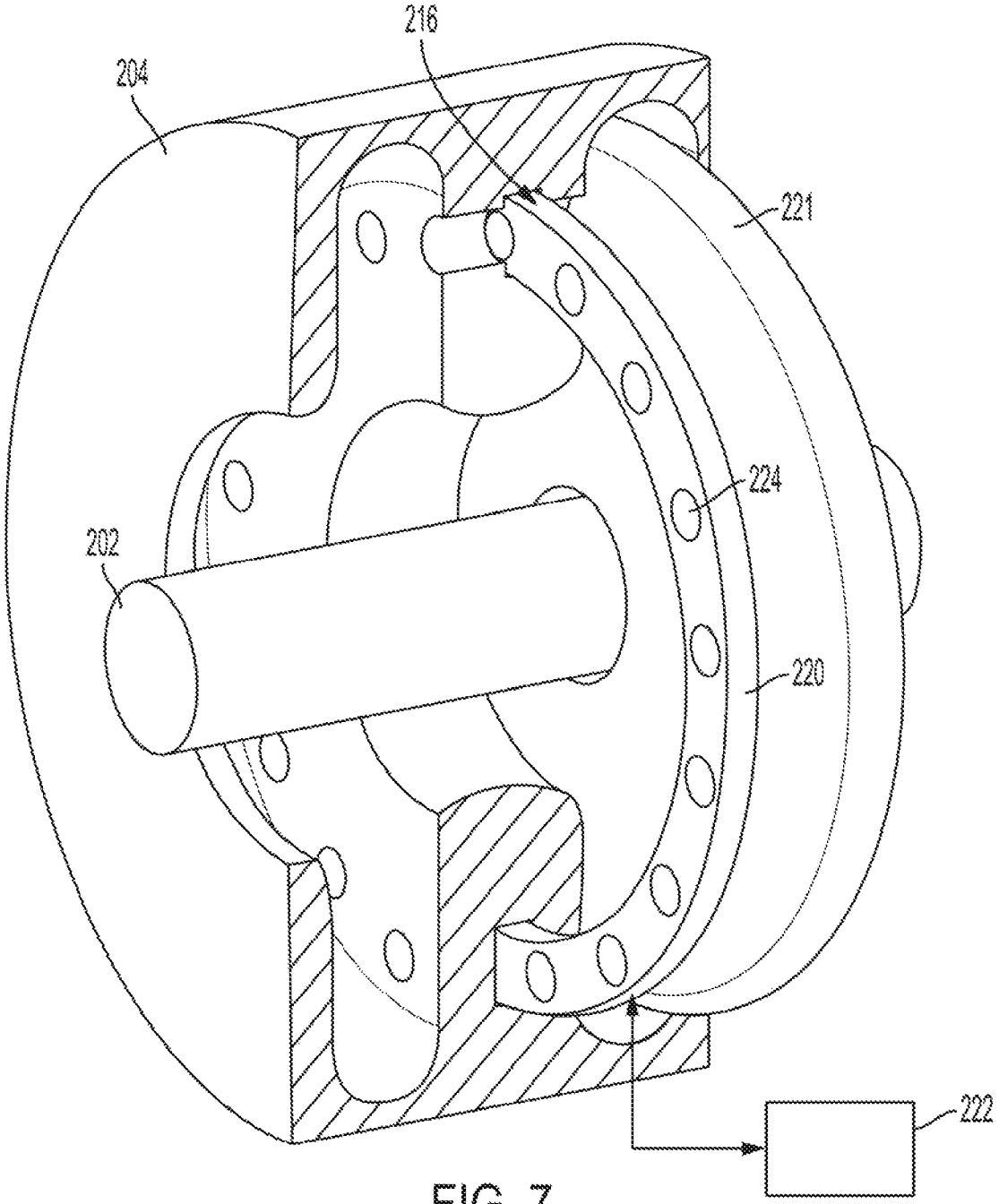
FIG. 7 is another cross-sectional perspective view of the turbomachine of FIG. 4.
Figure 8:
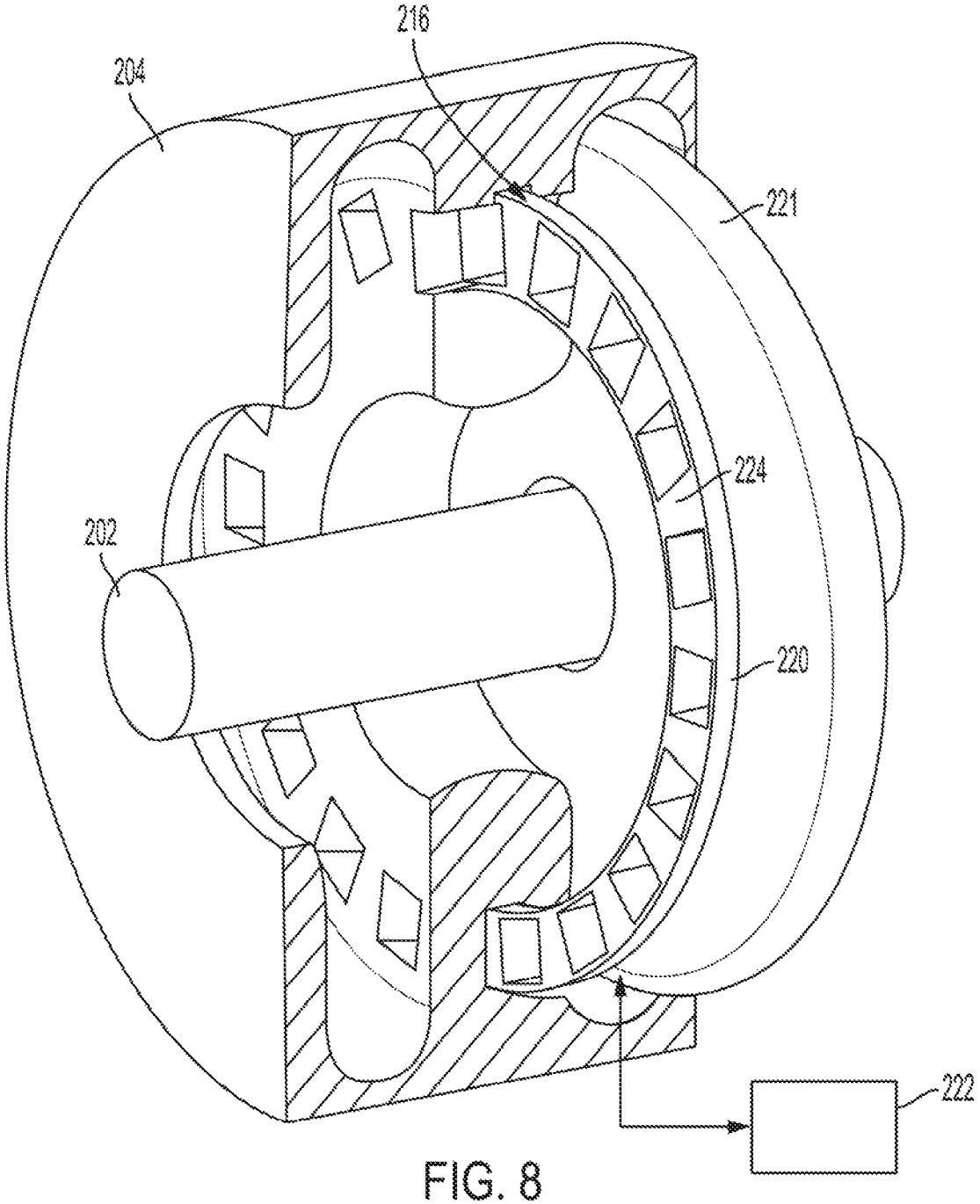
FIG. 8 is a cross-sectional perspective view of the turbomachine of FIG. 4 according to another example of the present disclosure.

With reference to FIGS. 5-7, the slotted disk 220 may define a plurality of circumferentially spaced openings 224 that extend therethrough. In one example, the openings 224 are circular in shape, but it is also contemplated that the openings 224 can have other shapes as well, including square, triangular, oval, and any other suitable shape. As shown in FIG. 8, in another example of the present disclosure, the openings 224 are generally rectangular in shape. During operation of the recycling process, the openings 224 of the slotted disk 220 are configured to align with a respective communication channel 216 defined in the casing 204 of the compressor 200. The disk member 220 may be rotated tangentially to establish and prevent fluid communication through the communication channel 216 via the openings 224 of the disk member 220. During rotation of the disk member 220, the alignment of the openings 224 with the communication channel 216 varies, allowing varying volumes of working fluid flow to pass therethrough.

In one position of the disk member 220, the communication channel 216 is completely blocked off by the disk member 220, thereby providing a complete stoppage of working fluid flow between the two stages of the compressor 200. A suitable sealing arrangement is also provided between the disk member 220 and the casing 204 of the compressor 200 to prevent unintentional leakage. In this position, the openings 224 of the disk member 220 are not aligned with the respective communication channel 216. In another position of the disk member 220, at least one opening 224 of the disk member 220 is aligned with the communication channel 216, thereby permitting a working fluid flow through the communication channel 216 to be directed from the downstream stage of the compressor 200 to the adjacent upstream stage of the compressor 200 to avoid surge in the compressor 200. This use of the disk member 220 provides an improved stage-to-stage surge control arrangement that utilizes stage return flow control valves to control the volume of working fluid that is directed from a downstream stage of the compressor 200 to an upstream stage of the compressor 200. The disk member 220 may be housed in the diaphragm 221 between adjacent stages of the compressor 200, such that the compressor 200 will include a corresponding number of disk members 220 and diaphragms 221. For example, a five-stage compressor would include four rotatable disk members 220. It is also contemplated that the number of openings 224 defined in the disk member 220 would correspond to the number of communication channels 216 defined in the casing 204 of the compressor 200 at the corresponding stage. By using the disk member 220, only a single moving component and one penetration to the exterior of the compressor casing 204 is required for the recycling process. This present stage-to-stage recycling arrangement provides a wider operating range for the compressor 200 and a faster response to changing operating conditions within the compressor 200.

In another example of the present disclosure, a method of recycling working fluid within the compressor 200 to avoid surge in the compressor 200 is also provided. Using this method, the working fluid is recycled between adjacent impeller stages instead of from the outlet or discharge end 208 of the compressor 200 all the way back to the inlet end 206 of the compressor 200 (see FIG. 3). In one example, the working fluid may be directed into the inlet end 206 of the compressor 200. The working fluid is then directed through at least two stages of the compressor 200. At least a portion of the working fluid is recycled from the downstream impeller 205 to the upstream impeller 205 via a connection or communication channel 216 defined in the compressor 200 between the two adjacent impellers 205. The recycled working fluid may then be directed downstream again toward the downstream impeller 205.

It is to be understood that the invention may assume various alternative variations and step sequences, except where expressly specified to the contrary. It is also to be understood that the specific devices and processes illustrated in the attached drawings and described in the specification are simply exemplary embodiments or aspects of the invention. Although the invention has been described in detail for the purpose of illustration based on what are currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope thereof. For example, it is to be understood that the present invention contemplates that to the extent possible, one or more features of any embodiment or aspect can be combined with one or more features of any other embodiment or aspect.

The invention claimed is:

1. A turbomachine, comprising:

a casing having an inlet end opposite an outlet end along a longitudinal axis of the casing;

a shaft assembly provided within the casing, the shaft assembly extending from the inlet end to the outlet end;

a plurality of rotating impellers extending radially outward from the shaft assembly; and a communication channel defined between two adjacent impellers to permit a backflow of fluid from a diffuser channel of a downstream impeller to a return channel of an adjacent upstream impeller, wherein the communication channel is a borehole defined in the casing between the two adjacent impellers.

2. The turbomachine of claim 1, wherein the communication channel is defined in the casing between the two adjacent impellers.

3. The turbomachine of claim 1, wherein the two adjacent impellers are positioned directly next to each other on the shaft assembly without an additional impeller positioned therebetween.

4. The turbomachine of claim 1, wherein the turbomachine is a multi-stage centrifugal compressor.

5. The turbomachine of claim 1, wherein a control valve is positioned within the communication channel to control a volume of fluid that is directed through the communication channel.

6. The turbomachine of claim 5, wherein the control valve is a check valve.

7. The turbomachine of claim 5, wherein the control valve is configured to permit the fluid to flow upstream, while preventing the fluid from flowing downstream between the two adjacent impellers.

8. The turbomachine of claim 5, wherein the control valve is configured to permit the fluid to flow upstream between the two adjacent impellers only after a predetermined pressure is achieved with the fluid.

9. A turbomachine, comprising:

a casing having an inlet end opposite an outlet end along a longitudinal axis of the casing;

a shaft assembly provided within the casing, the shaft assembly extending from the inlet end to the outlet end;

a plurality of rotating impellers extending radially outward from the shaft assembly;

a communication channel defined between two adjacent impellers to permit a backflow of fluid from a diffuser channel of a downstream impeller to a return channel of an adjacent upstream impeller; and a disk member rotatably positioned on the shaft assembly between the two adjacent impellers.

10. The turbomachine of claim 9, wherein the disk member defines at least one opening that is configured to be rotated between a first position in which the at least one opening is in line with the communication channel and a second position in which the at least one opening is rotated away from the communication channel.

11. The turbomachine of claim 9, further comprising a control mechanism configured to rotate the disk member.

12. The turbomachine of claim 9, wherein the communication channel is defined in the casing between the two adjacent impellers.

13. The turbomachine of claim 9, wherein the two adjacent impellers are positioned directly next to each other on the shaft assembly without an additional impeller positioned therebetween.

14. The turbomachine of claim 9, wherein the communication channel is a borehole defined in the casing between the two adjacent impellers.

15. The turbomachine of claim 9, wherein the turbomachine is a multi-stage centrifugal compressor.

16. The turbomachine of claim 9, wherein the disk member defines a plurality of circumferentially spaced openings.

17. A method of reducing surge in a turbomachine, comprising:

directing fluid through an inlet of the turbomachine;

directing the fluid through at least one stage of the turbomachine;

recycling a portion of the fluid upstream from a downstream impeller to an adjacent upstream impeller via a communication channel defined in the turbomachine between the two adjacent impellers, wherein the communication channel is a borehole defined in a casing between the two adjacent impellers; and directing the recycled fluid downstream in the turbomachine.

18. The method of claim 17, wherein a control valve is positioned within the communication channel.

19. The method of claim 17, wherein a disk member is provided between the adjacent impellers to control a flow of fluid through the communication channel.

* * * * *